US005209591A

United States Patent [19]

Mizutani et al.

[11] Patent Number: 5,209,591

[45] Date of Patent: May 11, 1993

[54] SHEET GUIDE MECHANISM FOR A PRINTER

[75] Inventors: Minoru Mizutani; Shyoichi Watanabe; Takeshi Asaba, all of Tokyo, Japan

[73] Assignee: Oki Electric Industry Co., Ltd., Tokyo, Japan

[21] Appl. No.: 716,961

[22] Filed: Jun. 18, 1991

[30] Foreign Application Priority Data

Jun. 22, 1990 [JP] Japan ..... 2-162798

[51] Int. Cl.[5] ..... B41J 13/16

[52] U.S. Cl. ..... 400/645; 400/642; 400/663

[58] Field of Search ..... 400/642, 645, 645.3, 400/645.5, 352, 663, 674, 619, 636.1, 639

[56] References Cited

U.S. PATENT DOCUMENTS 2,658,600 11/1953 Fleming ..... 400/642

4,497,588 2/1985 Volke et al. ..... 400/642 X 4,747,718 5/1988 Shimizu ..... 400/625

4,773,773 9/1988 Itoh ..... 400/663 X 4,808,020 2/1989 Kudo ..... 400/663

FOREIGN PATENT DOCUMENTS 277473 12/1986 Japan ..... 400/642

*Primary Examiner*—Edgar S. Burr

*Assistant Examiner*—Ren Yan

*Attorney, Agent, or Firm*—Spencer, Frank & Schneider

[57] ABSTRACT

A sheet guide mechanism, for use with a printer having a printing head on a carriage that is mounted on a carriage shaft for movement in a printing direction which is transverse to a feeding direction of a printing sheet supported by a platen, includes a sheet guide movably mounted on the carriage shaft. The sheet guide moves in the printing direction along with the printing head. The sheet guide can move in unison with the printing head without interfering with the printing operation.

18 Claims, 10 Drawing Sheets

SHEET GUIDE MECHANISM FOR A PRINTER

BACKGROUND OF THE INVENTION

1. Field of the Invention

The present invention relates to a sheet guide mechanism for use in a printer, and particularly to a sheet guide mechanism for guiding a sheet passing between a platen and a printing head which is moved laterally as it prints.

2. Description of the Related Art

One type of conventional sheet guide mechanism employs a bail roller. The bail roller of this mechanism can be operated manually or automatically.

A conventional sheet guide mechanism employing an automatically operable bail roller will be described with reference to FIG. 11.

The sheet guide mechanism includes a platen 1 and a paper chute 2 positioned substantially under the platen 1. The paper chute 2 has rotatable pinch rollers 3a and 3b attached thereto in order to press paper against the surface of the platen 1. A cut paper sheet can be fed along the upper surface of the paper chute 2. A continuous sheet can be fed along the upper surface of a pin tractor 4 positioned substantially under the paper chute 2. The platen 1 has a shaft 5 to which a separator 6 and a gear 7 are attached. The gear 7 rotates a gear 9 attached to the separator 6 by way of an idle gear 8. A pull-up roller 10 is coaxially attached to a shaft to which the gear 9 is attached and is rotatable when the platen 1 is rotated. A rib 11 is disposed opposite the pull-up roller 10. A printed sheet is discharged after passing between the pull-up roller 10 and the rib 11. A printing head 12 is disposed opposite the platen 1 and is mounted on a carriage which is slidably attached, via a carriage guide portion 13, to a carriage shaft 14. A ribbon protector 15 is attached to the carriage and disposed between the platen 1 and the printing head 12 for guiding sheet.

The sheet guide mechanism further includes bail arm 16 having a bail roller 17 which is attached to one end thereof. The bail roller 17 is urged toward the platen 1 by a spring 18. The bail arm 16 is turnable about a fulcrum 19. A roller 21 attached to one end of a link 20 contacts the bail arm 16. The link 20 is turnable about a fulcrum 22 and has a gear segment 20a. The gear segment 20a meshes with a gear 24 on the shaft of a motor 23. The bail arm 16, the spring 18, the link 20 and the motor 23 are attached to a side frame, not shown. Several bail rollers 17 are provided along the entire length of the platen 1. A sheet pressure plate 26 is attached to a frame 25 and has a tip end which presses paper against the platen 1. A guide rail 27 is attached to the frame 25 for guiding the movement of the carriage. The operation of the sheet guide mechanism will be described hereinafter. In order to print characters, a cut sheet is inserted from behind between the paper chute 2 and the separator 6. The cut sheet is pinched between the platen 1 and the pinch rollers 3a and 3b and the platen 1 is rotated to feed the cut sheet. A controller (not shown) rotates the motor 23 in the direction of the arrow A when a detector (not shown) detects the cut sheet. The link 20 meshing with the gear 24 is turned counterclockwise about the fulcrum 22 and positioned as shown in broken lines. This turns the bail arm 16 clockwise about the fulcrum 19, whereby the bail roller 17 is moved away from the platen 1.

When the cut sheet is delivered between the platen 1 and the printing head 12, i.e., when the cut sheet reaches the printing position, the controller drives the printing head so that the printing operation starts. The cut sheet is advanced upward by the platen 1 during the printing operation. When the upper end of the cut sheet is positioned where the bail rollers 17 are brought into contact with the platen 1, the controller rotates the motor 23 counterclockwise, i.e., in the direction opposite the arrow A. Accordingly, t he bail arm 16 is turned counterclockwise by way of the link 20 so that the bail roller 17 presses the cut sheet against the platen 1 for assuring the guidance of the cut sheet. The cut sheet is further advanced while the characters are printed on it, and the upper end of the cut sheet enters between the pull-up roller 10 and the rib 11 to be guided again.

If a continuous sheet is to be printed, it is fed from the pin tractor 4 toward the region under the paper chute 2. The continuous paper is further fed and the characters are printed on it in the same manner as the cut sheet.

Another type of conventional sheet guide mechanism employs bail rollers (corresponding to bail rollers 17) which can be manually moved toward or away from the platen 1 by operating a lever. The lever moves the bail rollers toward or away from the platen. It is preferable to start the printing operation after the upper end of the sheet is pressed by the bail rollers.

A further type of conventional sheet guide mechanism has no bail rollers. The printing head is moved to a central portion of the sheet (a so-called centering operation) when lines are changed until the upper end of the sheet enters between the pull-up roller and the rib, thereby facilitating the insertion of the upper end of the sheet. After the upper end of the sheet has entered between the pull-up roller and the rib, the centering operations are discontinued and normal printing is carried out.

However, when this type of conventional sheet guide mechanism is used the upper portion of the sheet is guided only by the ribbon protector. Accordingly, away from the printing head, in the axial direction of the platen, the upper portion of the sheet separates from the platen due to the stiffness of the sheet. In this state, sheet vibration occurs during the printing operation. As a result, high quality printing cannot be achieved.

A sheet guide mechanism of the type having automatically operable bail rollers requires links, a motor for driving the bail roller and electric circuits. This increases the size of the mechanism and results in high cost.

A sheet guide mechanism of the type having manually operable bail rollers requires operation of a lever each time a sheet is inserted between the platen and the paper chute or each time the pin tractor feeds a continuous sheet, thus involving laborious operation.

A sheet guide mechanism of the type having no bail rollers requires a centering operation each time a new line is started until the upper end of the sheet enters between the pull-up roller and the rib, thus lowering the throughput of the printer.

SUMMARY OF THE INVENTION

The present invention has been made in view of the problems set forth above. An object of the present invention is to provide a sheet guide mechanism having a sheet guide which is moved by the printing head in the printing direction so that characters can be printed on the sheet with high quality, thus realizing miniaturization, low cost, and improved throughput.

To achieve the object of the present invention, the sheet guide mechanism includes a sheet guide for guiding a printing sheet, the sheet guide being movable in the printing direction, and means for making the sheet guide follow the movement of the printing head.

The sheet guide mechanism may further include means for latching the sheet guide away from the moving area of the printing head.

DESCRIPTION OF THE PREFERRED EMBODIMENTS

A sheet guide mechanism according to three embodiments of the present invention will be described hereinafter, with components common to the embodiments being denoted by the same numerals.

Figure 1:
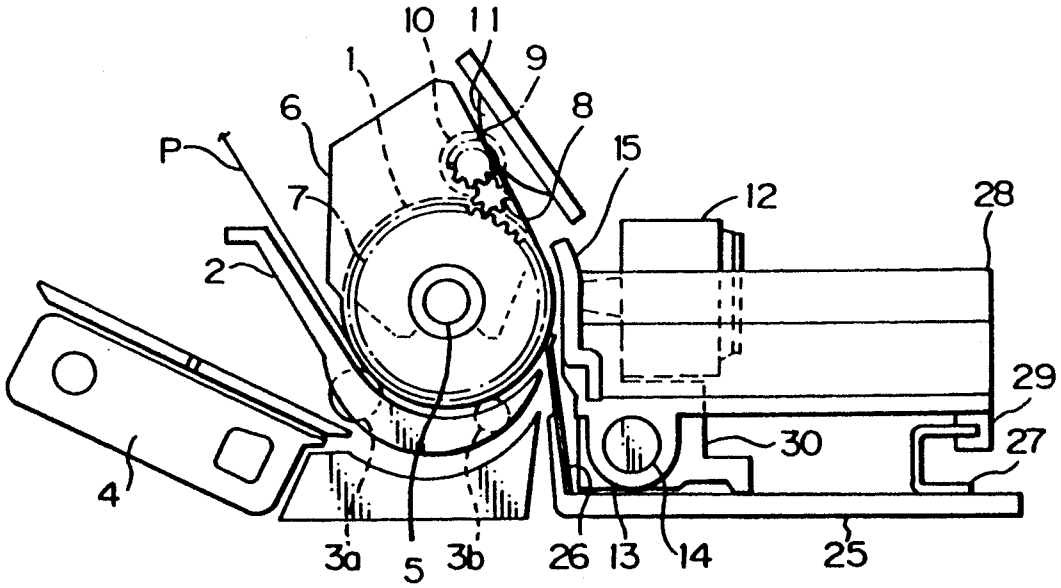
FIG. 1 is a schematic side view of a sheet guide mechanism according to a first embodiment of the present invention.
Figure 2:
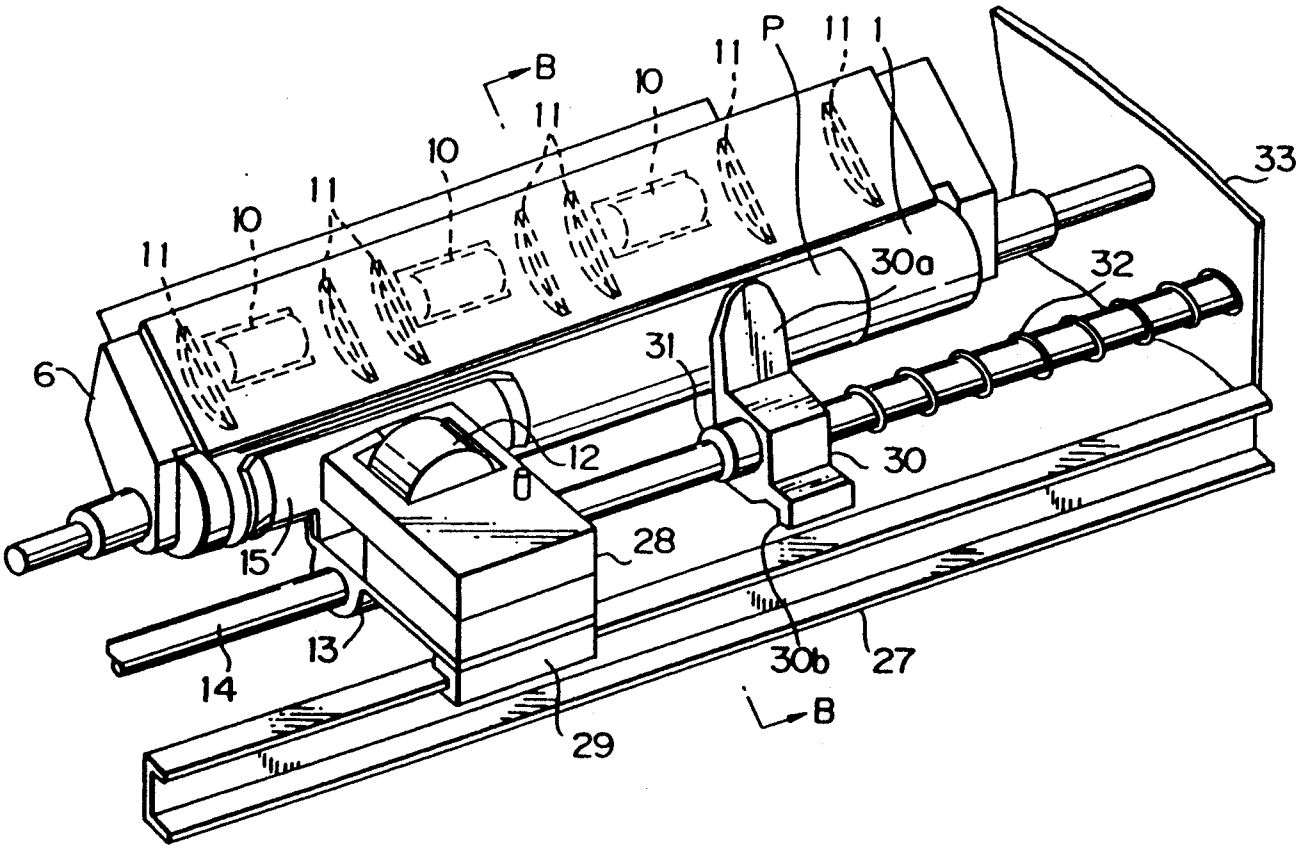
FIG. 2 is a perspective view of the sheet guide mechanism in FIG. 1.
Figure 3:
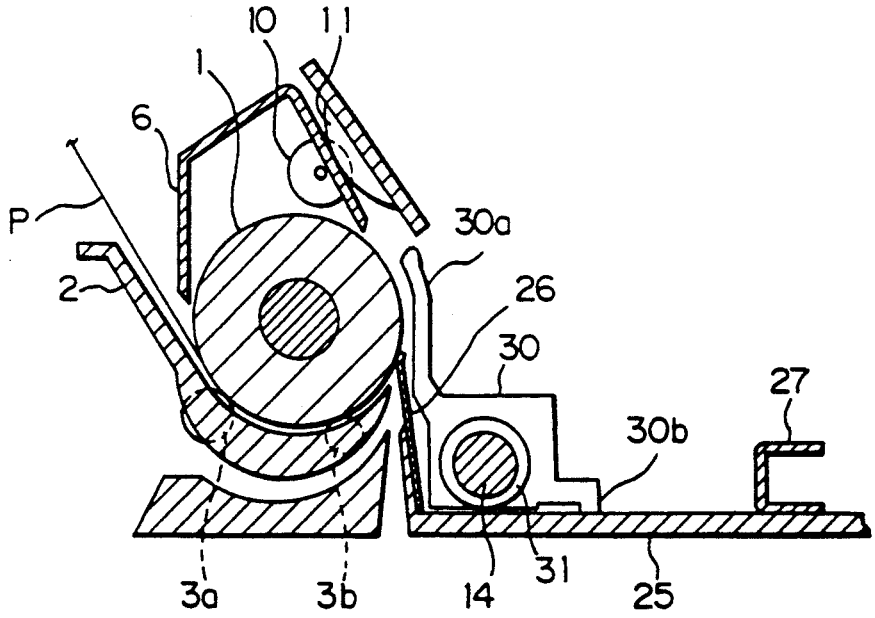
FIG. 3 is a cross-sectional view taken along the arrows B—B in FIG. 2.

First Embodiment (FIGS. 1 to 3)

The sheet guide mechanism according to the first embodiment will be described with reference to FIGS. 1 to 3.

The sheet guide mechanism includes a platen 1 attached to a shaft 5. A paper chute 2, along which a cut paper sheet P is fed, is positioned substantially under the platen 1. Pinch rollers 3*a* and 3*b* are attached to paper chute 2 and pinch the sheet P against the surface of the platen 1. A pin tractor 4, along which a continuous sheet is fed is positioned substantially under the paper chute 2. A separator 6 is coaxially attached to the shaft 5 of the platen 1 and has a gear 9. A gear 7 is coaxially attached to the shaft 5 of the platen 1 and meshes with an idle gear 8, which in turn meshes with gear 7. Pull-up rollers 10 are coaxially attached to a shaft to which the gear 9 is attached and rotate when the platen 1 is rotated. The sheet guide mechanism further includes ribs 11 which confront the pull-up rollers 10 and a carriage 28 with a carriage guide portion 13 which is slidably attached to a carriage shaft 14. The carriage shaft 14 is disposed parallel to the platen 1. The carriage 28 has a printing head 12 and an ink ribbon cassette (not illustrated) positioned at the upper portion thereof in confronting relation with the platen 1. A sheet presser plate 26 is attached to a frame 25. The tip end of presser plate 26 presses the sheet P against platen 1. A guide rail 27 is attached to frame 25 for guiding the movement of the carriage 28 via an engaging portion 29 positioned at the bottom of the rear end of the carriage 28. A ribbon protector 15 is positioned at the front end of carriage 28 and has curved surface for guiding the sheet along the platen 1. A sheet guide 30 is slidably attached to the carriage shaft 14.

The sheet guide 30 has a boss 31 integrated therewith at the carriage side, a sheet guide portion 30*a*, and a contact portion 30*b*. The sheet guide portion 30*a* is curved along the surface of the platen 1 and positioned in front of platen 1 in confronting relation it. The contact portion 30*b* is positioned at the rear end of sheet guide 30 and contacts the frame 25 so that the guide portion 30*a* is always positioned at a given interval relative to the platen 1 without permitting the sheet guide 30 to turn about the carriage shaft 14. A compression spring 32 is mounted on the carriage shaft 14 between the sheet guide 30 and one side frame 33. The sheet guide 30 is attached to one end of the compression spring 32 according to the first embodiment of the present invention, but it need not necessarily be attached thereto. The sheet guide 30 is positioned as illustrated in FIG. 2, which shows the state where the compression spring 32 is not compressed. Taking into account the width of the sheet P, the sheet guide 30 is positioned at an optimum position. The operation of the sheet guide mechanism according to the first embodiment will be described hereinafter.

When the sheet P is set as shown in FIG. 2, the carriage 13 and the sheet guide 30 are positioned substantially as illustrated in FIG. 1. At this time, the sheet guide 30 is positioned at the portion adjacent to the last string of characters in a printing region. Accordingly, the guide portion 30*a* of the sheet guide 30 is positioned so as to press the right half of the sheet P against the platen 1 and the ribbon protector 15 is positioned to press the left half of the sheet P against the platen 1.

To reach the position shown in FIG. 2, the cut sheet P is inserted from behind between the paper chute 2 and the separator 6. The sheet P is then fed along the surface of the platen 1 while it is pinched between the platen 1 and the pinch rollers 3*a* and 3*b*. The top of the sheet P passes the tip of the pressure plate 26 and is thereafter guided by the ribbon protector 15 and the guide portion 30*a* of the sheet guide 30 along the surface of the platen 1. Accordingly, the top portion of the cut sheet P is pressed against the platen 1 across its entire width as illustrated in FIG. 2. When the top portion of the cut sheet P is positioned opposite the tip end of the printing head, i.e., when the sheet P reaches the printing position, the sheet feeding operation is stopped and the printing operation starts at the same time.

When the printing operation starts, the carriage 13 moves along the carriage shaft 14 for spacing operation. The spacing operation of the carriage 13 does not cause the cut sheet P to vibrate since the cut sheet P is pressed with the ribbon protector 15 and the guide portion 30*a* of the sheet guide 30 at the printing position, thus assuring high quality printing. When the printing space in the lateral direction is short, the carriage 13 does not contact the sheet guide 30. When the printing spaced is long, the carriage 13 moves rightward in FIG. 1 and strikes against the boss 31 of the sheet guide 30. Since the elastic force of the compression spring 32 is relatively low, the carriage 13 moves the sheet guide 30 rightward. Boss 31 is designed so that the ribbon protector 15 does not contact the guide portion 30*a* when the carriage 13 strikes against the boss 31.

When the carriage 13 moves leftward, the sheet guide 30 is moved leftward by the compression spring 32 and accompanies the leftward movement of the carriage 13 and until the sheet guide 30 returns to the initial or original position. The printing operation is carried out by a repetition of these operations.

As the printing operation progresses, the cut sheet P is fed upward by the rotation of the platen 1 and is introduced between and clamped by the pull-up rollers 10 and the ribs 11 as illustrated in FIG. 2. Since the pull-up rollers 10 are rotated by the rotation of the platen 1 by way of the gear 8, the cut sheet P is fed upward by the platen 1 and by the pull-up rollers 10.

When a continuous sheet is to be printed, the continuous sheet is fed from the upper surface of the pin tractor 4 toward the printing position. The operation of the printer after the continuous sheet has been fed is the same as for the cut sheet P.

The sheet guide mechanism according to the first embodiment has the following advantages.

It is possible to print characters at the top margin of the sheet with high quality. It is also possible to improve throughput since a centering operation of the printing head is unnecessitated when the top portion of the sheet is introduced between the pull-up rollers 10 and the ribs 11.

Figure 4:
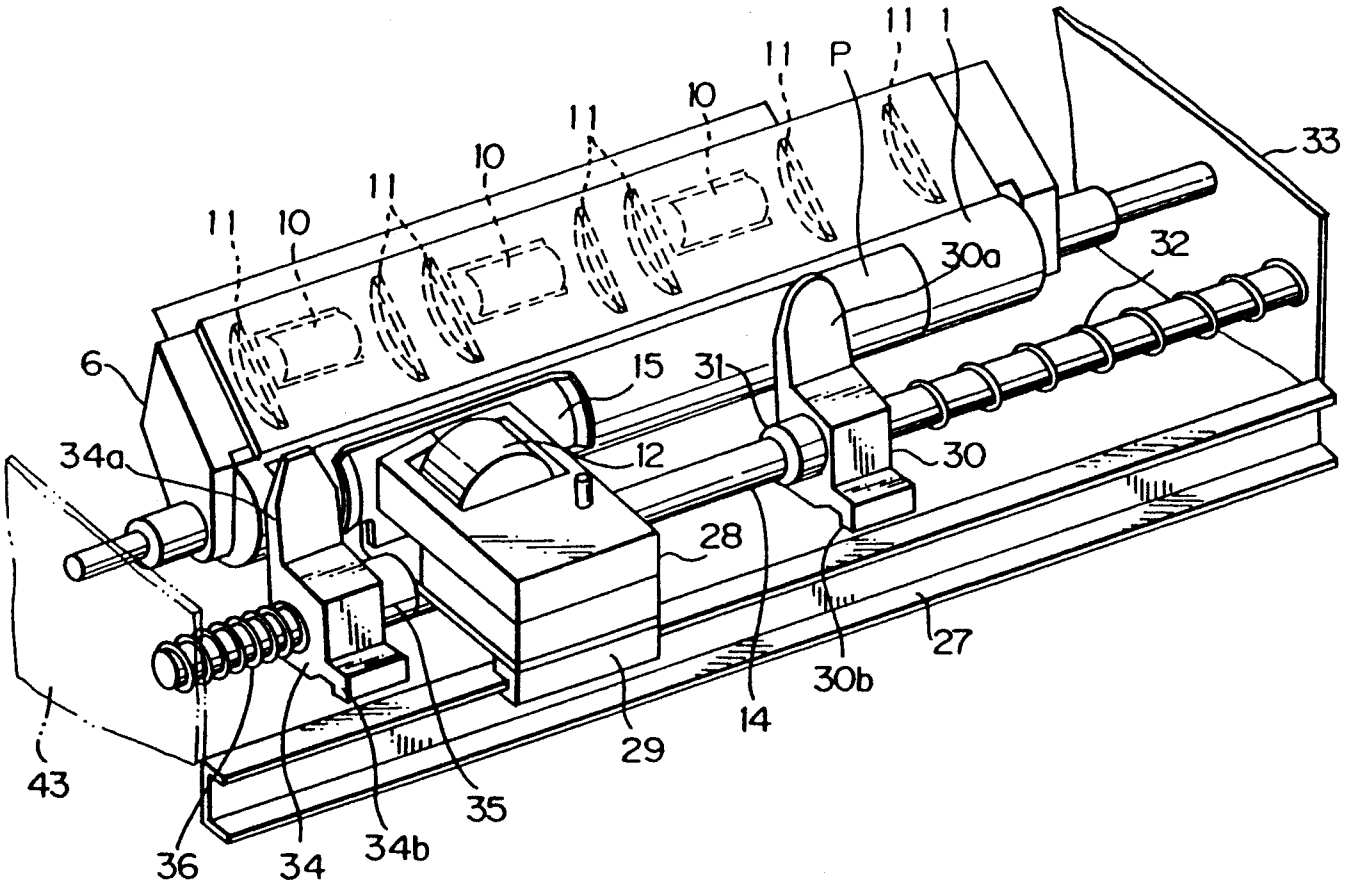
FIG. 4 is a perspective view of a sheet guide mechanism according to a second embodiment of the present invention.

Second Embodiment (FIG. 4)

A sheet guide mechanism in accordance with the second embodiment will be described with reference to FIG. 3.

The arrangement of the sheet guide mechanism according to the second embodiment is substantially the same as that of the first embodiment except that another sheet guide is added.

That is, sheet guides 30 and 34 are disposed at both sides of the printing head 12. The sheet guide 34 has the same shape as the sheet guide 30 and has a boss 35 integrated thereinto on the side facing the carriage 28. A compression spring 36 is disposed around the carriage shaft 14 and is positioned between the sheet guide 34 and a side frame 43.

With the arrangement of the sheet guide mechanism according to the second embodiment, the printing sheet is always pressed against the platen 1, thereby further improving the guiding function of the sheet guide mechanism.

Figure 5:
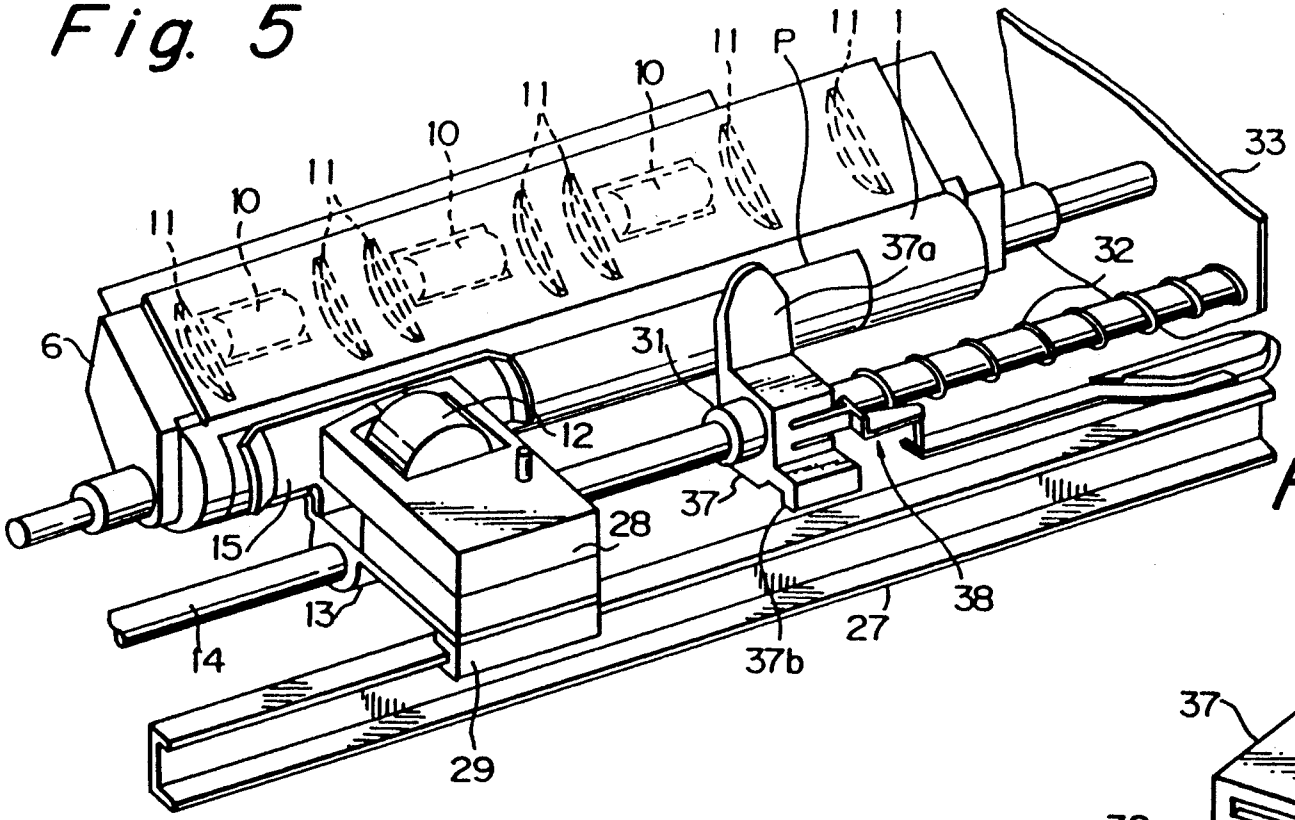
FIG. 5 is a perspective view of a sheet guide mechanism according to a third embodiment of the present invention.
Figure 6:
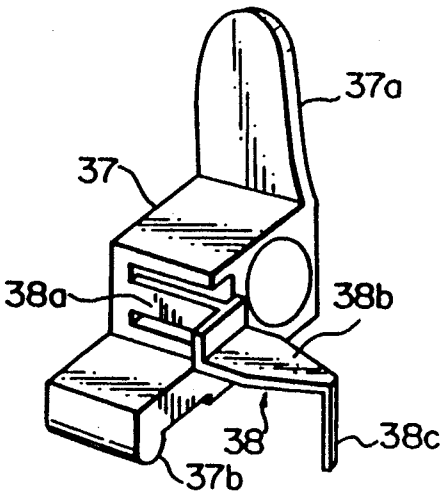
FIG. 6 is an enlarged view of a sheet guide employed in the sheet guide mechanism in FIG. 5.
Figure 7:
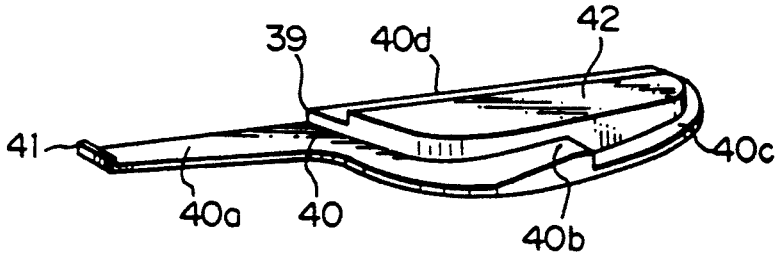
FIG. 7 is a perspective view of a latching cam employed in the sheet guide mechanism in FIG. 5.

Third Embodiment (FIGS. 5 to 7)

A sheet guide mechanism according to the third embodiment of the present invention will be described with reference to FIGS. 5 to 7.

The sheet guide mechanism according to the third embodiment has a sheet guide 37 slidably mounted on the carriage shaft 14 like the sheet guides 30, 34 and 37 according to the first and second embodiments of the present invention. However, the arrangement of the sheet guide 37 is slightly different from those of the first and second embodiments.

The sheet guide 37 comprises a guide portion 37*a* which has a curved configuration and which is disposed opposite the platen 1, a contact portion 37*b* which contacts the frame 25 and prevents the sheet guide 37 from being turned, and a latch portion 38. As illustrated in FIG. 6, the latch portion 38 comprises, a vertical flexible portion 38*a* and a horizontal flexible portion 38*b* which has a pawl 38*c* directed downward at the tip end thereof. The vertical flexible portion 38*a* is movable in the horizontal direction while the horizontal flexible portion 38*b* is movable in the vertical direction. Accordingly, the pawl 38*c* is elastically movable in both the horizontal and vertical directions.

A latching cam 39 is disposed between the carriage shaft 14 and the guide rail 28. As illustrated in FIG. 7, the latching cam 39 comprises a slide portion 40 and a hill portion 42. The pawl 38*c* of the sheet guide 37 slides on the slide portion 40. The slide portion 40 also has a first part 40*a* which is flat, a second part 40*b* which rises gradually from a front portion thereof to a rear portion thereof (where an abrupt drop is provided), a third part 40*c* which rises gently after the abrupt drop of the second part 40*b*, and a fourth part 40*d* which is flat and which is positioned higher than the first to the third parts 40*a* to 40*c*. Accordingly, there is a difference in height between the fourth part 40*d* and the first part 40*a* as illustrated in FIG. 7. The hill portion 42 is defined and surrounded by the second to fourth parts 40*b* to 40*d*. The hill portion 42 guides the pawl 38*c* of the sheet guide 37 when the pawl 38*c* slides on the slide portion 40. The latching cam 39 has a limiter 41 at one end. The pawl 38*c* of the sheet guide 37 can be held by the limiter 41. The latching cam 39 is disposed in such a manner that the pawl 38*c* of the sheet guide 37 contacts the upper surface of the slide portion 40.

Except the sheet guide 37, the other mechanical arrangements are the same as those of the first embodiment, and hence an explanation of them is omitted.

The electrical arrangement of the sheet guide mechanism according to the third embodiment will be described with reference to FIG. 8.

A control portion 50 for controlling the entire operation of the printer is connected to a head driver 51 for controlling the printing head 12, a motor driver 52 for controlling a spacing motor 54, and a sensor circuit 53 for converting an optical signal received by a photosensor 55 into an electric signal and supplying the electric signal to the control portion 50. The spacing motor 54 (not illustrated in FIG. 5) is provided to move the carriage 28 along the carriage shaft 14. The photosensor 55 detects when the top margin of the sheet has been inserted between the pull-up rollers 10 and the ribs 11.

The operation of the sheet guide mechanism according to the third embodiment of the present invention will be described hereinafter.

Both the carriage 13 and the sheet guide 37 are disposed at the positions illustrated in FIG. 5 when the sheet is set on the platen 1. The setting position is the same as that of the first embodiment. Consequently, when the top margin of the sheet P is fed into the printing position as illustrated in FIG. 5, it is pressed against the platen 1 by both the ribbon protector 15 and the guide portion 37*a* of the sheet guide 37. The printing operation is begun in this state.

Figure 8:
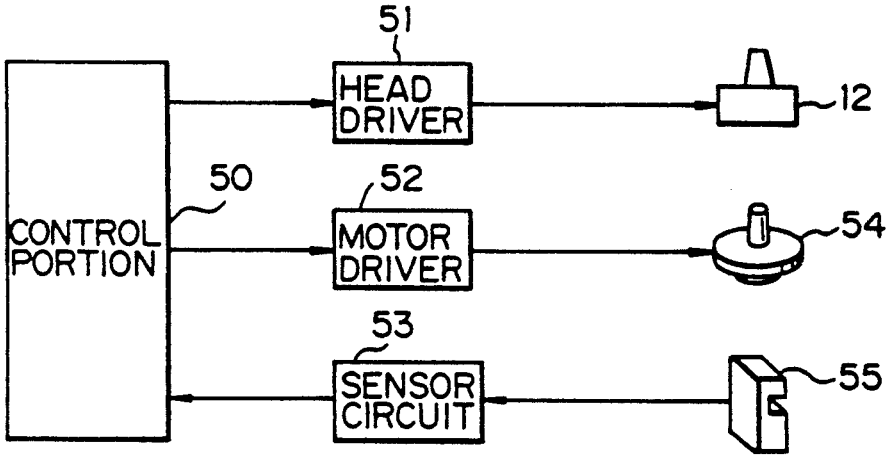
FIG. 8 is a block diagram showing the control portion of a printer having the sheet guide mechanism in FIG. 5.

In FIG. 8, when a printing instruction is issued by the control portion 50, the head driver 51 drives the printing head 12 and the motor driver 52 drives the spacing motor 54. The carriage 28 is moved along the carriage shaft 14 by the spacing motor 54. When the carriage 13 strikes against the boss 31 of the sheet guide 37, the sheet guide 37 is pushed by the carriage 13 and the tip end of the pawl 38*c* of the latch portion 38 moves on the first part 40*a* of the slide portion 40 of the latching cam 39 as the top line of printing is completed.

When the top margin of the sheet P is fed upward by the rotation of the platen 1 as the printing operation progresses, the sheet P enters between the pull-up rollers 10 and the ribs 11. When the photosensor 55 (FIG. 8) detects the entrance of the sheet P between the pull-up rollers 10 and the ribs 11, the sensor circuit 53 issues a detection signal which is supplied to the control portion 50. The control portion 50 then controls the operation of the printer so as to retract the sheet guide 37.

Figure 9:
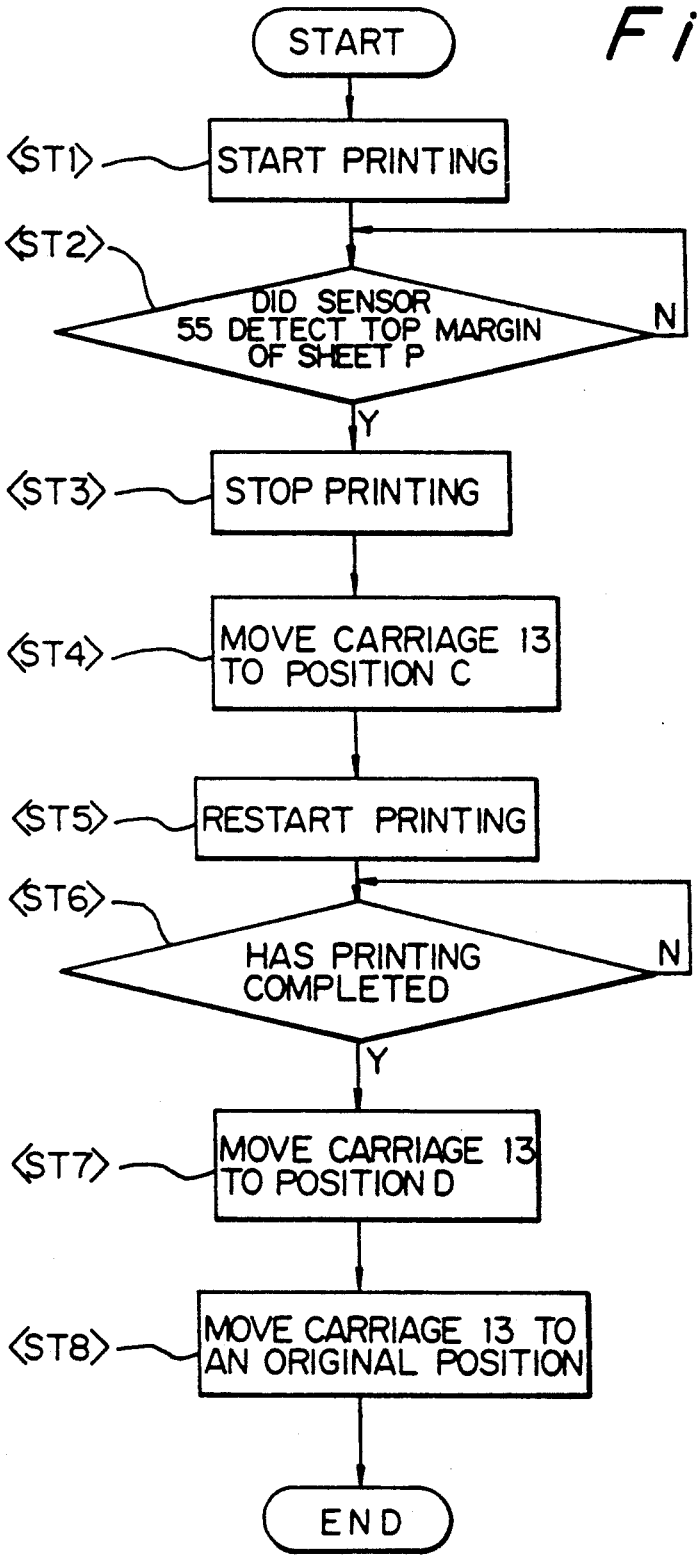
FIG. 9 is a flow chart for controlling the operation of the sheet guide mechanism in FIG. 5.
Figure 10A:
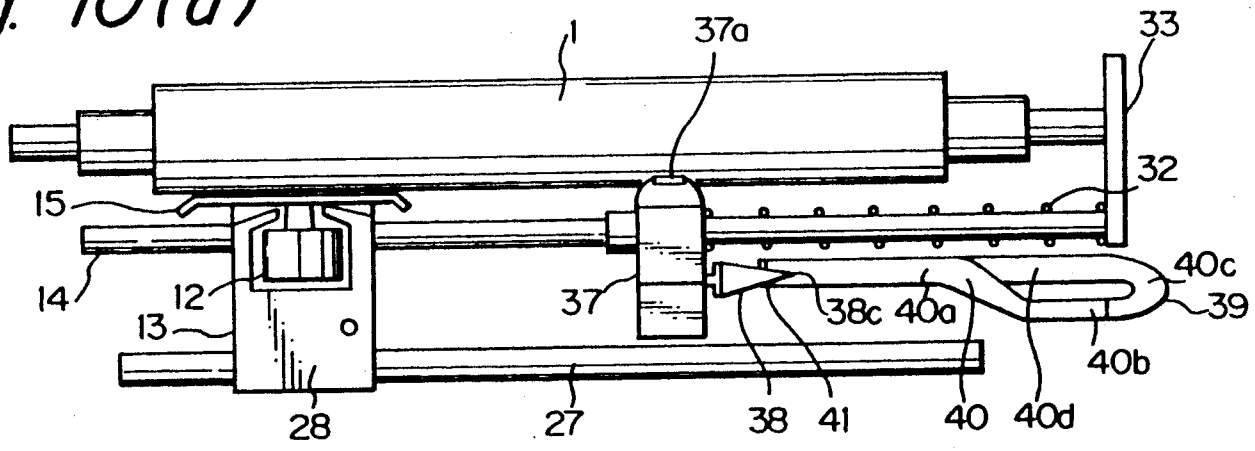
FIG. 10(*a*) to 10(*d*) are views showing the operation of the sheet guide mechanism in FIG. 5.
Figure 10B:
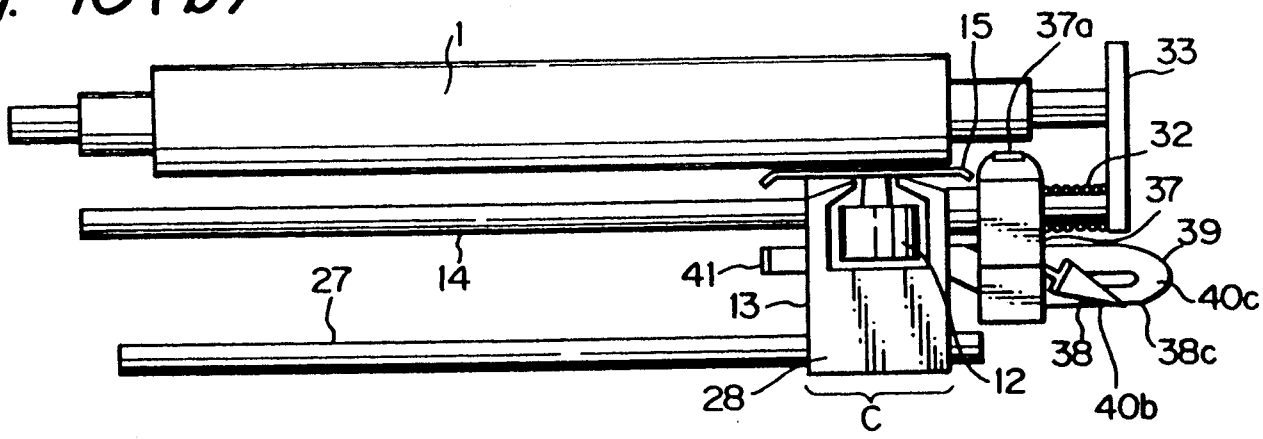
Figure 10C:
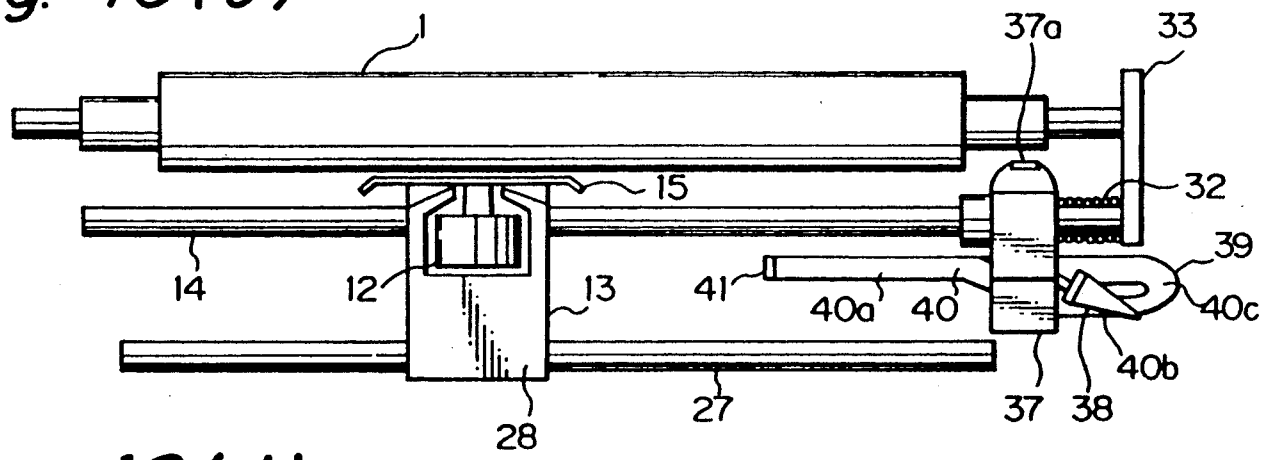
Figure 10D:
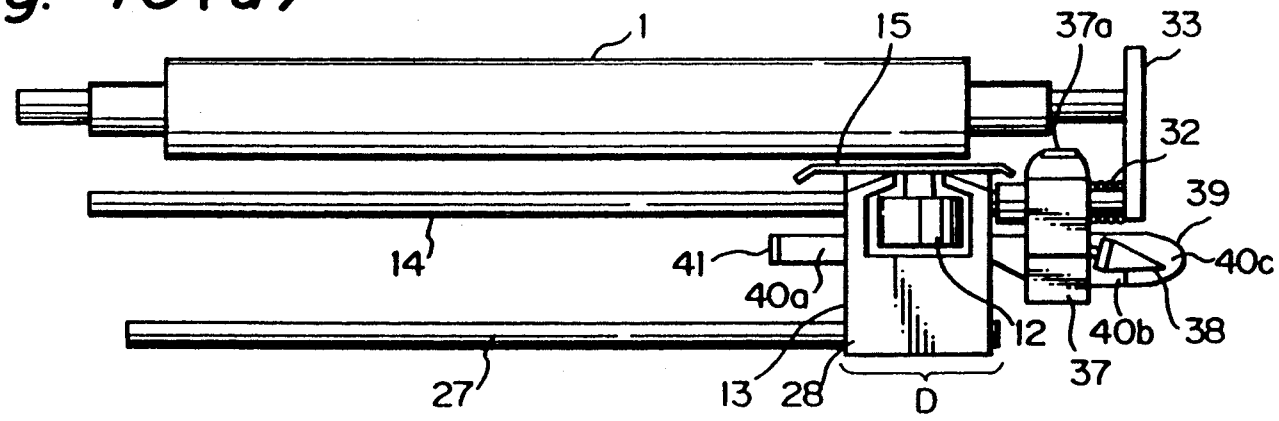
Figure 11:
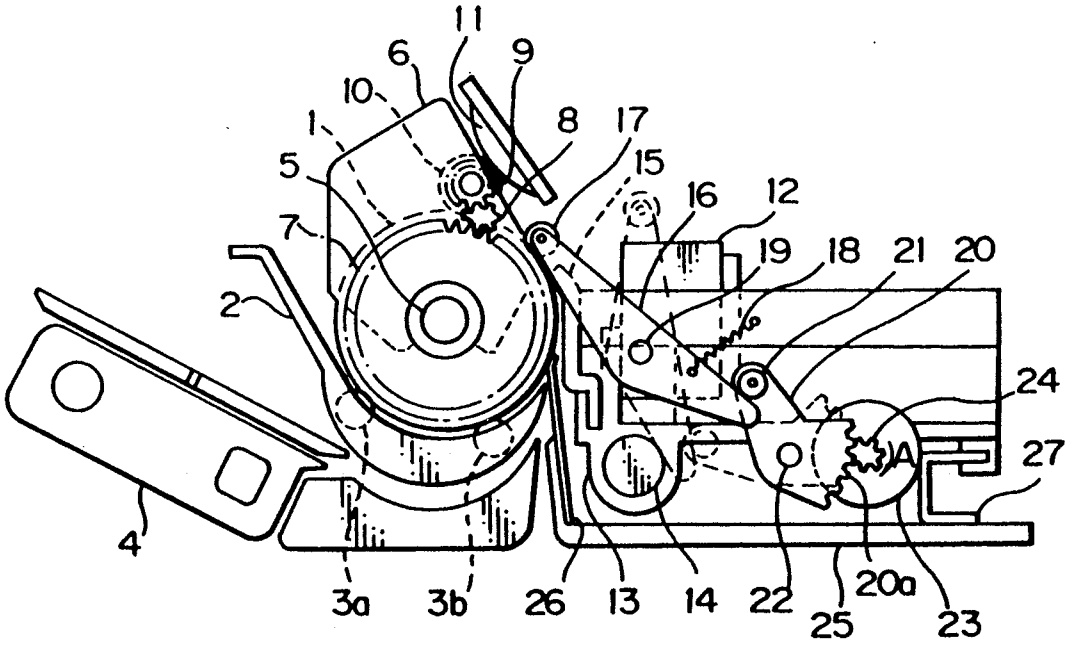
Fig. 11 PRIOR ART
FIG. 11 is a schematic side view showing a conventional sheet guide mechanism.

The printing operation will be described with reference to the flow chart in FIG. 9 and the arrangement of the sheet guide mechanism showing the printing operation in FIGS. 10(*a*) to 10(*d*).

During the printing operation (Step 1), when the control portion 50 receives the detection signal (Step 2), the printing operation is interrupted (Step 3) and the control portion 50 issues an instruction to the motor driver 52 to move the carriage 28 to a position C (FIG. 10*b*) adjacent to the right end of the platen 1 (Step 4). The tip end of the pawl 38*c* of the latch portion 38 moves on the slide portion 40 from the first part 40*a* to the second part 40*b*, and rides over the abrupt drop at the end of the second part 40*b*. The pawl 38*c* is hooked by the second part 40*b* of the slide portion 40 and the sheet guide 37 is thereby prevented from moving leftward as shown in FIG. 10(*c*). At this state, the printing operation is restarted (Step 5). The retraction position of the sheet guide 37 is set so that the carriage 28 does not come into contact with it during the printing operation.

When the printing operation is completed (Step 6), the retracted sheet guide 37 is returned to the original position. The carriage 28 is first moved to a position D (Step 7), which is situated to the right of the position C as illustrated in FIG. 10(*d*). The sheet guide 37 is pushed by the carriage 28 while the tip end of the pawl 38*c* of the latch portion 38 moves on the slide portion 40 from the second part 40*b* to the third part 40*c*. The carriage 28 is then moved leftward (Step 8), and the tip end of the pawl 38*c* slides on the slide portion 40 from the third part 40*c* to the fourth part 40*d* and then to the first part 40*a*. The compression spring 32 returns sheet guide 37 to the position where the pawl 38*c* is caught by the limiter 41 and stopped as illustrated in FIG. 10(*a*).

A photosensor is employed as the detection means for detecting the top margin of the sheet P inserted between the pull-up rollers 10 and the ribs. However, it is possible to control the retraction of the sheet guide 37 based on the feed distance of the sheet P. In this case, a feed distance which brings the top of the sheet P between the pull-up rollers 10 and the ribs 11 is predetermined. This feed distance is counted by calculating the printed lines on the sheet. The calculation can be made by the control portion 50 (FIG. 8).

As mentioned above, the top margin of the sheet is pinched between the pull-up rollers 10 and the ribs 11 while the sheet is in contact with the platen 1, and the sheet guide 37 is forced to a retracted position where the carriage 28 does not contact it. Since it is not necessary to press the sheet guide 37 against the platen 1 after the sheet has been pinched between the pull-up rollers 10 and the ribs 11, the load on the spacing motor can be reduced. Furthermore, no noise is generated by striking the carriage 28 against the sheet guide 37.

It is possible to urge the sheet guide using a tension spring instead of the compression spring 32 (and spring 36 in the second embodiment). It is also possible to provide a new shaft for guiding the sheet guide instead of the carriage shaft. It is also possible to provide sheet guides at both sides of the printing head 12 as described in the second embodiment.

What is claimed is:

1. A printer for use with a printing sheet having first and second parallel edges, comprising:
   - a rotatably mounted platen for supporting the printing sheet and for feeding the printing sheet in a feed direction;
   - an elongated member disposed parallel to the platen;
   - a carriage slidably mounted on the elongated member for movement in a printing direction which is transverse to the feed direction and the edges of the printing sheet;
   - drive means for moving the carriage in the printing direction;
   - a printing head mounted on the carriage;
   - a sheet guide for guiding the printing sheet, the sheet guide being disposed closer to the second edge of the printing sheet than to the first edge, the sheet guide additionally being aligned with the carriage and being disposed further than the carriage from the first edge of the printing sheet, the sheet guide being mounted for movement in the printing direction between a rest position and a remote position, the sheet guide facing the printing sheet when in the rest position and being spaced apart from the printing sheet in the printing direction when in the remote position;
   - a resilient member to urge the sheet guide toward its rest position; and
   - holding means for latching the sheet guide at a withdrawn position when the carriage pushes it to the withdrawn position, the withdrawn position being located between the rest position and the remote position and being close to the remote position, and for unlatching the sheet guide when the carriage subsequently pushes it to the remote position.

2. A printer according to claim 1, wherein the sheet guide has a guide portion configured to conform with the surface of the platen for allowing the printing sheet to contact the platen.

3. A printer according to claim 2, further comprising a frame positioned under the sheet guide, and wherein the sheet guide has a portion which contacts the frame to keep the distance between the guide position and the platen constant.

4. A printer according to claim 1, wherein the second edge of the printing sheet is a right edge.

5. A printer according to claim 1, wherein the printing sheet has a printing region, and wherein the rest position of the sheet guide is positioned adjacent to the last characters in the printing region.

6. A printer according to claim 1, wherein the resilient member is a compression spring.

7. A printer according to claim 6, further comprising a printer side frame, and wherein the compression spring is positioned between the sheet guide and the printer side frame.

8. A printer according to claim 1, wherein the holding means comprises a latching cam having a first holding portion for holding the sheet guide at the rest position and a second holding portion for holding the sheet guide at the withdrawn position.

9. A printer according to claim 8, wherein the holding means further comprises a projection on the sheet guide, the projection being held by the holding portions of the latching cam.

10. A printer according to claim 9, wherein the latching cam additionally has a slide portion on which the projection of the sheet guide moves, the slide portion including a first slide portion part for guiding the projection from the first holding portion to the second holding portion and a second slide portion part for guiding the projection from the second holding portion to the first slide portion part.

11. A printer for use with a printing sheet having left and right parallel edges, comprising:

a cylindrical platen for supporting the printing sheet and for feeding the printing sheet in a feed direction;

a carriage shaft disposed parallel to the platen;

a frame member beneath the carriage shaft;

a carriage slidably mounted on the carriage shaft for movement in a printing direction which is transverse to the feed direction of the printing sheet;

a printing head mounted on the carriage;

a sheet guide for guiding the printing sheet, the sheet guide being mounted on the carriage shaft for movement in the printing direction between a rest position and a remote position, the sheet guide being disposed closer to the right edge of the printing sheet than the left edge, the sheet guide additionally being disposed further than the carriage from the left edge of the printing sheet, the sheet guide including a guide portion having a configuration which conforms with the surface of the platen for urging the printing sheet into contact with the platen, a contact portion for contacting the frame to keep the distance between the guide portion and the platen constant, and a projection, the sheet guide being positioned adjacent to the last characters in a printing region when in its rest position and being positioned to the right of the printing region when in its remote position;

a compression spring disposed on the carriage shaft to urge the sheet guide toward its rest position; and latching cam means having a first holding portion for engaging the projection of the sheet guide to prevent the sheet guide from moving to the left of the rest position, having as second holding portion for engaging the projection of the sheet guide to hold the sheet guide at a withdrawn position which is located between the rest position and the remote position and which is close to the remote position, having a first slide portion for guiding the projection of the sheet guide from the first holding portion to the second holding portion, and having a second slide portion for guiding the projection from the second holding portion to the remote position and then back to the first slide portion.

12. A printer, comprising:

a rotatably mounted platen for supporting a printing sheet and for feeding the printing sheet in a feed direction;

an elongated member disposed parallel to the platen;

a carriage slidably mounted on the elongated member for movement in a printing direction which is transverse to the feed direction of the printing sheet, the carriage having a left side and a right side;

drive means for moving the carriage in the printing direction;

a printing head mounting on the carriage;

a right sheet guide for guiding the printing sheet, the right sheet guide being mounted for movement in the printing direction between a right rest position and a right remote position, the right sheet guide being positioned for engagement by the right side of the carriage so as to be displaceable by the carriage from the right rest position toward the right remote position; and a left sheet guide for guiding the printing sheet, the left sheet guide being mounted for movement in the printing direction between a left rest position and a left remote position, the left printing guide being positioned for engagement by the left side of the carriage so as to be displaceable by the carriage from the left rest position toward the left remote position.

13. A printer according to claim 12, further comprising right spring means for urging the right sheet guide toward the right rest position, and left spring means for urging the left sheet guide toward the left rest position.

14. A sheet guide mechanism for a printer having a platen and having a printing head carriage which moves along a path parallel to the platen, the path having first and second ends and having a printing region between the ends where the carriage moves while characters are being printed, said sheet guide mechanism comprising:

a sheet guide;

means for movably mounting the sheet guide so that the sheet guide can be pushed by the carriage from a rest position within the printing range to a displaced region near one end of the path;

means for urging the sheet guide towards its rest position; and holding means for latching the sheet guide when it is pushed to the displaced region by the carriage and for unlatching the sheet guide for return to the rest position when the sheet guide is subsequently pushed by the carriage while at the displaced region.

15. The sheet guide mechanism of claim 14, wherein the holding means comprises a pawl, and resilient means for connecting the pawl to the sheet guide.

16. The sheet guide mechanism of claim 15, wherein the holding means further comprises a latching cam having a hill portion around which the pawl moves.

17. The sheet guide mechanism of claim 16, wherein the hill portion has a near end and a far end, and wherein the latching cam further comprises means for providing a path for the pawl around the hill portion, the path having an abrupt drop adjacent the rear end of the hill portion to force the pawl to move around the hill portion in a predetermined direction and having another abrupt drop between the ends of the hill portion to hold the pawl until it is subsequently pushed around the far end of the hill portion.

18. The sheet guide mechanism of claim 17, wherein the latching cam further comprises a linear portion extending from the path at a position adjacent the near end of the hill portion, the linear portion being terminated by a limiter which is engaged by the pawl when the sheet guide is in its rest position.

* * * * *